US006753649B1

(12) United States Patent
Bechtel et al.

(10) Patent No.: US 6,753,649 B1
(45) Date of Patent: Jun. 22, 2004

(54) PLASMA PICTURE SCREEN WITH UV LIGHT REFLECTING FRONT PLATE COATING

(75) Inventors: Helmut Bechtel, Roetgen (DE); Wolfgang Busselt, Roetgen (DE); Harald Gläser, Aachen (DE); Claus Feldmann, Aachen (DE); Joachim Opitz, Aachen (DE); Detlef Uwe Wiechert, Asldorf (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 380 days.

(21) Appl. No.: 09/663,298

(22) Filed: Sep. 15, 2000

(30) Foreign Application Priority Data

Sep. 15, 1999 (DE) ..... 199 44 202

(51) Int. Cl.[7] ..... H01J 17/49
(52) U.S. Cl. ..... 313/587; 313/582
(58) Field of Search ..... 313/582–587, 313/483–485, 326, 112; 345/60

(56) References Cited

U.S. PATENT DOCUMENTS 5,703,437 A * 12/1997 Komaki ..... 313/587
6,149,967 A * 11/2000 Mitamura et al. ..... 427/66
6,329,751 B2 * 12/2001 Yoo ..... 313/582

OTHER PUBLICATIONS

"Improvement of Luminos Efficiency in Coplanar Plasma Display Panel by UV Reflection Layer" by Takaaki Murata et al. in IEEj, 1998, pp. 98–61. No month.
"Improvemnt of Luminous Efficiency and Phosphor Lifetime in Barrier Discharge Plasma Display Panel" by T. Shinkai et al. in IDW '98, pp. 539–542. No month.

* cited by examiner

*Primary Examiner*—Joseph Williams
(74) *Attorney, Agent, or Firm*—Aaron Waxler

(57) ABSTRACT

A plasma picture screen is disclosed. In one embodiment, an AC plasma picture screen with a coplanar arrangement which has an enhanced luminance is provided. A layer, which has a high reflection in the wavelength range of the plasma emission (145 to 200 nm) and a high transmission in the visible wavelength range, is provided on the front plate. The front plate includes a glass plate on which a dielectric layer, a protective layer, a reflective layer are provided. The reflective layer reflects UV light emitted in the direction of the front plate back towards phosphors. The optical properties of the UV light reflecting layer are realized with inorganic particles with a particle diameter of between 200 nm and 500 nm and a layer thickness from 0.5 $\mu$m to 5 $\mu$m, or with agglomerates of inorganic particles with a particle diameter of between 10 nm and 200 nm and a layer thickness of 0.2 $\mu$m to 10 $\mu$m.

6 Claims, 2 Drawing Sheets

PLASMA PICTURE SCREEN WITH UV LIGHT REFLECTING FRONT PLATE COATING

Figure 1:
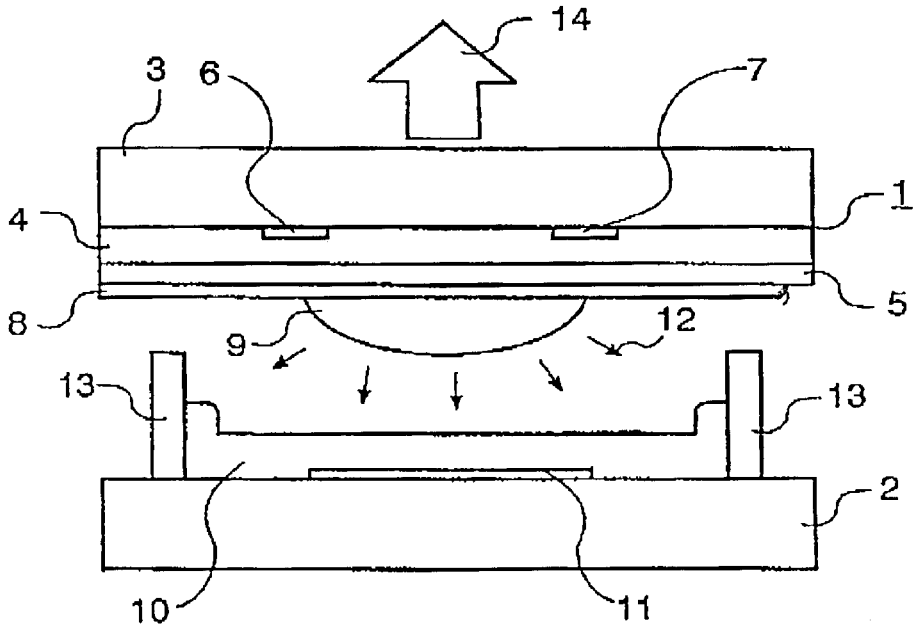

The invention relates to a plasma picture screen with a front plate comprising a glass plate on which a dielectric layer and a protective layer are provided, a back plate, a number of gas-filled plasma cells arranged between said plates and separated by partitioning walls, and a plurality of electrodes on the front plate and the back plate for generating corona discharges.

Plasma picture screens can generate color pictures with high resolution and have a compact construction. A plasma picture screen comprises a hermetically closed glass cell which is filled with a gas, with electrodes in a grid arrangement. When a voltage is applied, a gas discharge is generated which emits light in the ultraviolet range. This UV light is converted into visible light by phosphors and emitted through the front plate of the glass cell to the viewer.

Two types of plasma picture screens can be distinguished in principle: a matrix arrangement and a coplanar arrangement. In the matrix arrangement, the gas discharge is ignited and maintained at the intersection of two electrodes on the front and back plate. In the coplanar arrangement, the gas discharge is maintained between the electrodes on the front plate and is ignited at the intersection with an electrode, a so-called address electrode, on the back plate. The address electrode in this case lies below the phosphor layer. This arrangement implies that half the UV light generated in the gas discharge will arrive at the front plate, where it is absorbed in the layers present there. This effect is even enhanced for a portion of the UV light, because the UV light is re-absorbed in the gas space in that gas atoms are excited from the ground state into a higher energy level. The light is indeed emitted again subsequently, but it is diverted from its original direction, so that also light which had originally been directed towards the phosphor layers can arrive on the front plate.

The luminance of a plasma picture screen depends to a major extent on the efficacy with which the UV light excites the phosphors. To increase the luminance, T. Murata, Y. Okita, S. Kobayashi, T. Shinkai, and K. Terai describe a plasma picture screen in IEEJ, 1998, EP 98-61, wherein the front plate comprises not only a dielectric layer and the discharge electrodes, but also a UV light reflecting layer. A similar construction of a front plate was described by the same authors in IDW, 1998, 539–542. In this case the front plate in addition comprises a protective layer of MgO, and the UV light reflecting layer is present between the dielectric layer and the protective layer. In either case said layer has the task of reflecting UV light emitted in the direction of the front plate towards the phosphors.

The invention has for its object to provide a plasma picture screen with an improved luminance.

This object is achieved by means of a plasma picture screen with a front plate comprising a glass plate on which a dielectric layer and a protective layer are provided, a back plate, a number of gas-filled plasma cells arranged between said plates and separated by partitioning walls, and a plurality of electrodes on the front plate and the back plate for generating corona discharges, characterized in that a UV light reflecting layer is provided on the protective layer.

Contrary to the front plate described in IDW, 1998, 539–542, the UV light reflecting layer does not lie between the dielectric layer and the protective layer. This has the advantage that the UV light does not pass through the protective layer, but is reflected directly at the lower surface of the front plate. An absorption of the UV light in the protective layer is prevented thereby. The additional protective layer in the plasma picture screen according to the invention as compared with that of IEEJ, 1998, EP 98-61 protects the subjacent layers from the high ignition voltages and temperatures which are required for a plasma discharge and arise in the plasma discharge, respectively.

It is particularly preferred that the UV light reflecting layer comprises oxides of the composition $M_2O$, such as $Li_2O$, or oxides of the composition MO, with M chosen from the group Mg, Ca, Sr, and Pa, or oxides of the composition $M_2O_3$, with M chosen from the group B, Al, Sc, Y, and La, or oxides of the composition $MO_2$, with M chosen from the group Si, Ge, Sn, Ti, Zr, and Hf, or oxides of the composition $M'M''_2O_4$, with M' chosen from the group Mg, Ca, Sr, and Ba, and M" chosen from the group Al, Sc, Y, and La, or fluorides of the composition MF, with M chosen from the group Li, Na, K, Rb, Cs, and Ag, or fluorides of the composition $MF_2$, with M chosen from the group Mg, Ca, Sr, Ba, Sn, Cu, Zn, and Pb, or fluorides of the composition $MF_3$, with M chosen from the group La, Pr, Sm, Eu, Gd, Yb, and Lu, or fluorides of the composition $M'M''F_3$, with M' chosen from the group Li, Na, K, Rb, and Cs, and M" chosen from the group Mg, Ca, Sr, and Ba, or phosphates of the composition $M_3PO_4$, with M chosen from the group Li, Na, K, Rb, and Cs, or phosphates of the composition $M_3(PO_4)_2$, with M chosen from the group Mg, Ca, Sr, and Ba, or phosphates of the composition $MPO_4$, with M chosen from the group Al, Sc, Y, La, Pr, Sm, Eu, Gd, Yb, and Lu, or phosphates of the composition $M_3(PO_4)_4$, with M chosen from the group Ti, Zr, and Hf, or metaphosphates with a chain length n of between 3 and 9 and the composition $(M_xPO_3)_n$, with x=1 if M is chosen from the group Li, Na, K, Rb, and Cs, x=½ if M is chosen from the group Mg, Ca, Sr, Ba, Sn, Cu, Zn, and Pb, x=⅓ if M is chosen from the group Al, Sc, Y, La, Pr, Sm, Eu, Gd, Yb, and Lu, and x=¼ if M is chosen from the group Ti, Hf, and Zr, or polyphosphates with a chain length n between $10^1$ and $10^6$ and the composition $(M_xPO_3)_n$, with x=1 if M is chosen from the group Li, Na, K, Rb, and Cs, x=½ if M is chosen from the group Mg, Ca, Sr, Ba, Sn, Cu, Zn, and Pb, x=⅓ if M is chosen from the group Al, Sc, Y, La, Pr, Sm, Eu, Gd, Yb, and Lu, and x=¼ if M is chosen from the group Ti, Hf, and Zr, or primary phosphates of the composition $MH_2PO_4$, with M chosen from the group Li, Na, K, Rb, and Cs, or $NH_4H_2PO_4$, or diamond.

Particles with these compositions show no or only a small absorption in the wavelength range from 147 to 700 nm and withstand the high temperatures prevailing during manufacture of a plasma picture screen. In addition, these particles can be manufactured with particle diameters between 10 nm and 500 nm.

It may be preferred that the UV light reflecting layer comprises particles with a particle diameter between 200 nm and 500 nm.

Particles of these diameters show a substantially greater light scattering in the UV wavelength range than in the visible wavelength range.

It is preferred in this embodiment that the UV light reflecting layer has a thickness of 0.5 $\mu$m to 5 $\mu$m.

Besides the scattering characteristics of the individual (isolated) particles and their wavelength dependence, the thickness of the layer of scattering particles also plays a part. Thus the reflection of a layer of particles which are less strongly scattering can be high if the layer thickness is great. The use of particles with a particle diameter between 200 nm and 500 nm and a layer thickness of 0.5 $\mu$m to 5 $\mu$m results in a UV light reflecting layer which reflects strongly in the wavelength range of the plasma emission and transmits the visible light emitted by the phosphors.

It may also be preferred that the UV light reflecting layer comprises agglomerates of particles having particle diameters between 10 nm and 200 nm.

Particles with particle diameters between 10 nm and 200 nm do not scatter UV light, so that layers made from such particles show no appreciable reflection. If it is ensured by means of suitable measures that the particles form agglomerates which are substantially greater than 100 nm, the layer will behave optically as if it were a layer of larger particles. The interaction between the light and the agglomerates is determined both by the size of the agglomerates and by the particle diameters of the particles forming the agglomerates. The variations in density and refractive index in the agglomerates also has an influence on the wavelength dependence of the reflection.

It is preferred in this embodiment that the UV light reflecting layer has a thickness of 0.2 $\mu$m to 10 $\mu$m.

It is furthermore preferred that the UV light reflecting layer covers the protective layer completely or only partly.

A partial covering of the protective layer with the UV light reflecting layer already leads to a considerable improvement in the luminance. It may be advantageous for the plasma discharge if the protective layer, which is usually made of MgO, is covered only partly. This is because the voltage required for igniting the plasma is reduced by the MgO layer.

Figure 2:
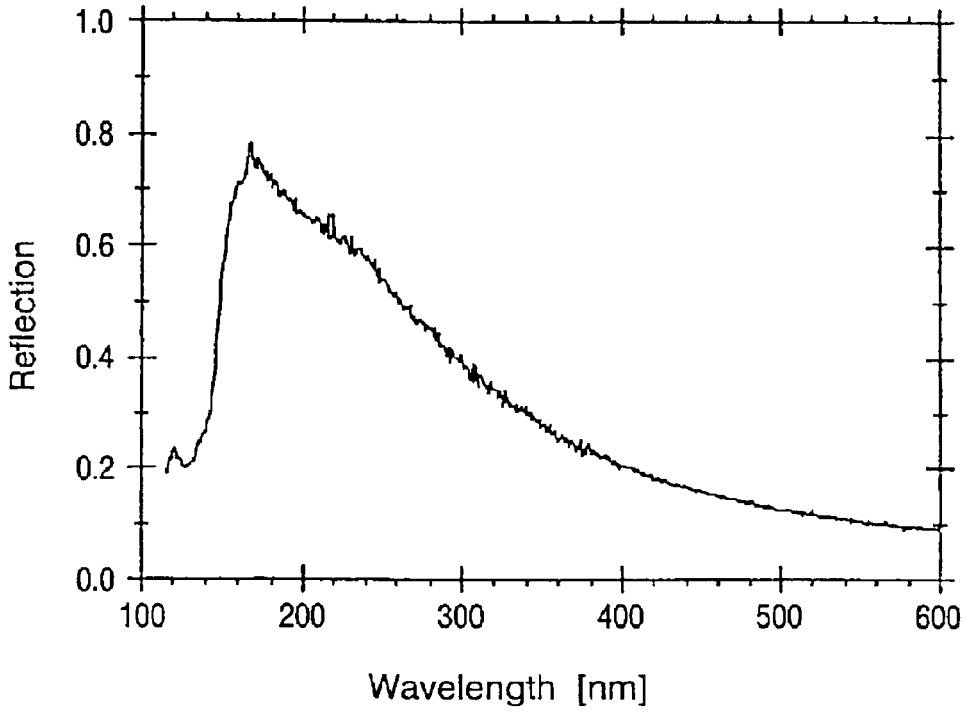

The invention will be explained in more detail below with reference to two Figures and eight embodiments, in which FIG. 1 shows the construction and operating principle of a single plasma cell in an AC plasma picture screen, and FIG. 2 plots the reflection characteristics of a UV light reflecting layer according to the invention.

In FIG. 1, a plasma cell of an AC plasma picture screen with a coplanar arrangement comprises a front plate 1 and a back plate 2. The front plate 1 comprises a glass plate 3 on which a dielectric layer 4 and thereon a protective layer 5 are provided. The protective layer 5 is preferably made of MgO, and the dielectric layer 4 is made, for example, of glass comprising PbO. Parallel, strip-shaped discharge electrodes 6, 7 are provided on the glass plate 3 such that they are covered by the dielectric layer 4. The discharge electrodes 6, 7 are made, for example, from metal or ITO. A UV light reflecting layer 8, which reflects radiation 12 in the UV range and transmits visible light 14, is provided on the protective layer 5. The back plate 2 is made of glass, and parallel, strip-shaped address electrodes 11, for example made of Ag, are provided on the back plate 2 so as to run perpendicularly to the discharge electrodes 6, 7. Said address electrodes are covered with phosphor layers 10 in one of the three basic colors red, green, or blue. The individual phosphor layers 10 are separated by partitioning walls 13, so-called barriers, which are preferably made of a dielectric material.

A gas, preferably a mixture of rare gases, for example He, Ne, Xe, or Kr, is present in the discharge cavity and also between the discharge electrodes 6, 7, of which one is the cathode and the other the anode, alternately. After the surface discharge has been ignited, such that charges can flow along a discharge path which lies in the plasma range 9 between the discharge electrodes 6, 7, a plasma is formed in the plasma range 9 whereby radiation 12 is generated in the UV range, in particular in the VUV range, in dependence on the composition of the gas. This UV radiation 12 excites the phosphor layers 10 into phosphorescence, so that visible light 14 in the three basic colors is emitted and issues through the front plate 1 to the exterior, thus forming a luminous pixel on the picture screen.

The dielectric layer 4 lying over the transparent discharge electrodes 6, 7 in AC plasma picture screens serves inter alia to prevent a direct discharge between the discharge electrodes 6, 7 of conductive material, and thus the formation of an arc during ignition of the discharge.

To manufacture a front plate 1 with a UV light reflecting layer 8, the discharge electrodes 6, 7 are first provided by means of a vapor deposition process on a glass plate 3 whose size corresponds to the desired picture screen size. Then a dielectric layer 4 is provided, and a protective layer 5 on the dielectric layer 4.

Suspensions of the particles with the desired particle diameter are first prepared for the UV light reflecting layer 8. Particles which may be used are, for example, oxides, fluorides, phosphates, metaphosphates, or polyphosphates of various main group or subgroup metals. Oxides used may be, for example, the oxides of the first main group such $Li_2O$ or oxides of the second main group such as MgO, CaO, SrO, and BaO, or oxides of the third main group such as, for example, $B_2O_3$ and $Al_2O_3$, or oxides of the third sub-group such as $Sc_2O_3$, $Y_2O_3$, and $La_2O_3$, or oxides of the fourth main group such as, for example, $SiO_2$, $GeO_2$, and $SnO_2$, or oxides of the fourth sub-group such as $TiO_2$, $ZrO_2$, and $HfO_2$, or mixed oxides such as $MgAl_2)_4$, $CaAl_2O_4$, or $BaAl_2O_4$. Fluorides used may be, for example, fluorides of the first main group such as LiF, NaF, KF, RbF, and CsF, or fluorides of the first sub-group such as AgF, or fluorides of the second main group such as $MgF_2$, $CaF_2$, $SrF_2$, and $BaF_2$, or fluorides of the fourth main group such as $SnF_2$ and $PbF_2$, or fluorides of the first sub-group such as $CuF_2$, or fluorides of the second sub-group such as $ZnF_2$, or fluorides of the lanthanides such as $LaF_3$, $PrF_3$, $SmF_3$, $EuF_3$, $GdF_3$, $YbF_3$, and $LuF_3$, or mixed fluorides such as $LiMgF_3$ and $KMgF_3$. Phosphates used may be, for example, phosphates of the first main group such as $Li_3PO_4$, $Na_3PO_4$, $K_3PO_4$, $Rb_3PO_4$, and $Cs_3PO_4$, or phosphates of the second main group such as $Mg_3(PO_4)_2$, $Ca_3(PO_4)_2$, $Sr_3(PO_4)_2$, or $Ba_3(PO_4)_2$, or phosphates of the third main group such as $AlPO_4$, or phosphates of the third sub-group such as $ScPO_4$, $YPO_4$, and $LaPO_4$, or phosphates of the lanthanides such as $LaPO_4$, $PrPO_4$, $SmPO_4$, $EuPO_4$, $GdPO_4$, $YbPO_4$, and $LuPO_4$, or phosphates of the fourth sub-group such as $Ti_3(PO_4)_4$, $Zr_3(PO_4)_4$, and $Hf_3(PO_4)_4$. Metaphosphates with a chain length n of between 3 and 9 may be, for example, metaphosphates of the first main group such as $Li_3(PO_3)_3$, $Na_3(PO_3)_3$, $K_3(PO_3)_3$, $Rb_3(PO_3)_3$, and $Cs_3(PO_3)$, or metaphosphates of the second main group such as $Mg(PO_3)_2$, $Ca(PO_3)_2$, $Sr(PO_3)_2$, and $Ba(PO_3)_2$, or metaphosphates of the third main group such as $Al(PO_3)_3$, or metaphosphates of the third sub-group such as $SC(PO_3)_3$, $Y(PO_3)_3$, and $La(PO_3)_3$, or metaphosphates of the fourth sub-group such as $Ti_3(PO_3)_4$, $Zr_3(PO_3)_4$, and $Hf_3(PO_3)_4$, or $Zn(PO_3)_2$. Polyphosphates used may be, for example, polyphosphates $(M_xPO_3)_n$ of the metals Li, Na, K, Rb, Cs, Mg, Ca, Sr, Ba, Al, Sc, Y, La, Ti, Zr, Hf, Zn, Pr, Sm, Eu, Gd, Yb, or Lu, with a chain length n of between $10^1$ and $10^6$ and with a value for x which lies between 0.25 and 1 in dependence on the oxidation value of the metal used. Metal cations may be partly replaced with protons in all these polyphosphates. Alternatively, however, primary phosphates such as, for example, $KH_2PO_4$, $NaH_2PO_4$, and $NH_4H_2PO_4$, or diamond may be used in the UV light reflecting layer 8.

Alternatively, the suspensions may also comprise precursors of the particles according to the invention, which are then converted into the desired particles by a thermal treatment. Thus, for example, a suspension with $Mg(OH)_2$ can be thermally converted into an MgO layer after being provided on the protective layer 5.

The suspensions are preferably prepared in an aqueous solution. It may be necessary in a number of cases to work with organic solvent systems, for example if the powder used reacts chemically with water or is dissolved therein.

The preparation of the suspensions takes place by various methods in dependence on material an d particle size. A possibility is that the particles are synthesized from suitable precursors. The alternative possibility is that the particles are directly utilized.

Metal salts are first dissolved in water for the situation in which particles are prepared from precursors in the preparation of the suspensions. The metal salts have the composition $MX_n \cdot yH_2O$, in which M is, for example, a metal or several metals chosen from the group Li, Na, K, Rb, Cs, Mg, Ca, Sr, Ba, Al, Sc, La, Y, Sn, Ti, Zr, Hf, Ag, Pb, Cu, Pr, Sm, Eu, Gd, Yb, Lu, and Zn. X is, for example, one or several of the anions $NO_3^-$; $RO^-$, $^-O_2C—CO_2^-$; while y is a number greater than or equal to zero, and n is an integer number between 1 and 4, depending on the oxidation value of the metal cation $M^{n+}$. Alkoxides $RO^-$ used may be, for example, propoxide and butoxide.

The particles according to the invention with a particle diameter of between 200 nm and 500 nm are then obtained either through a thermal treatment such as, for example, heating in a reflow process, by an acid treatment such as, for example, the addition of acetic acid, by an alkaline treatment such as the addition of soda lye, or the introduction of ammonia gas and/or the addition of the desired complementary ion. The complementary ions are added to the aqueous metal salt solution in the form of salts and may be, for example, ammonium salts such as $NH_4F$, or phosphates such as sodium metaphosphates, or long-chain polyphosphate salts.

The suspensions thus obtained are mixed with an associative thickener and/or a dispersing agent.

Alternatively, particles such as, for example, $Li_2O$, MgO, CaO, SiO, BaO, $B_2O_3$, $Al_2O_3$, $Sc_2O_3$, $Y_2O_3$, $La_2O_3$, $SiO_2$, $GeO_2$, $SnO_2$, $TiO_2$, $ZrO_2$, $HfO_2$, or $MgAl_2O_4$ with a particle diameter of between 200 nm and 500 nm may be directly suspended in the aqueous solution and subsequently mixed with an associative thickener and/or a dispersing agent.

If the particles used have an average particle diameter smaller than 200 nm, they will be agglomerated in a controlled manner. For this purpose, the powders of the relevant particles are dispersed in a liquid phase, which is preferably an aqueous solution. The liquid phase also contains additives which influence the colloidal stability of the dispersed particles. Additives used may be, for example, electrostatic or steric dispersing agents or electrolytes such as ammonium halides, ammonium nitrates, organic ammonium salts, or salts of organic acids such as acetates, citrates, oxalates, and tartrates.

The particles are dispersed through milling in a ball mill with and without stirrer, stirring in a dissolver, dispersing by shearing in an ultraturrax device, an ultrasonic bath, or an ultrasonic sonotrode. The powder agglomerates are broken up by the dispersing power and defined agglomerate sizes are obtained.

The suspensions may furthermore be mixed with additives which modify the flow properties of the suspensions and give them thixotropic properties. Additives used for this may be small quantities of organic, soluble polymers such as polyvinyl alcohol, polyacrylate derivatives, associatively acting thickeners, or fully dispersed colloidal substances.

Very fine-particle colloids with a particle diameter of approximately 10 nm may also be used for a controlled agglomerate formation, which colloids in an aqueous solution exhibit a surface charge which is opposed to the surface charge of the particles used.

The suspensions obtained by these various methods may be provided on the protective layer 5 of the front plate 1 by means of a wide variety of processes. A continuous layer may be provided by spin coating, meniscus coating, or blade coating. If a structured layer is desired, printing processes such as silk-screen printing or flexo printing may be used.

The layers thus provided are treated with an air flow, heat, infrared radiation, or combinations thereof for drying purposes. To prevent the formation of cracks in the layer owing to shrinkage, the drying process is carried out sufficiently slowly. The layers are given a thermal aftertreatrnent for removing additives such as the electrolytes, the dispersing agent, or the polymers. The additives can be removed without residues through heating of the layers at 450° C. It may be necessary in some cases to use temperatures of 600° C. for achieving a full pyrolysis of the polymers. If the suspension provided comprises a precursor of a particle according to the invention, the relevant conversion will also take place during the thermal treatment.

Subsequently, the front plate 1 together with further components such as, for example, a back plate 2 with address electrodes 11 covered with phosphor layers 10 in one of the three basic colors red, green, or blue, and a mixture of rare gases, is used for the manufacture of an AC plasma picture screen.

Preferably, the UV light reflecting layer 8 is used in AC plasma picture screens in which the plasma cells are excited by an AC voltage and the discharge electrodes 6, 7 are covered with a dielectric layer 4. In principle, however, a UV light reflecting layer may also be used for DC plasma picture screens in which the discharge electrodes 6, 7 are not covered by a dielectric layer 4.

FIG. 2 shows the reflection characteristic of a UV light reflecting layer according to the invention made of $SiO_2$ with particle diameters lying between 10 and 110 nm and a layer thickness of 3 $\mu$m. The maximum for the layer reflectivity lies in the range of 170 nm. This is particularly advantageous because a major portion of the UV radiation in a xenon discharge is emitted at 172 nm. The reflectivity of the UV light reflecting layer is clearly lower in the wavelength range corresponding to visible light.

Embodiments of the invention will be explained in more detail below, representing examples of how the invention may be implemented in practice.

Embodiment 1

The pH value of a solution of 4 g $Mg(NO_3)_2 \cdot 6H_2O$ in 100 ml $H_2O$ was set for 11.0 through the introduction of $NH_3$ for a period of 4 h. Colloidal $Mg(OH)_2$ particles were formed thereby with an average particle diameter of 350 nm. The suspension was mixed with 10 ml of a 10% pigment dispersing agent solution and 10 ml of a 10% associative thickener solution under stirring. A layer of $Mg(OH)_2$ particles was provided on the protective layer 5 of a front plate 1 by means of spin coating, which front plate comprises a glass plate 3, a dielectric layer 4 of glass containing PbO, a protective layer 5 of MgO, and two discharge electrodes 6, 7 made of ITO. Then the entire front plate 1 was dried, given an aftertreatment at 450° C. for 2 h, and the $Mg(OH)_2$ was converted into MgO. The layer thickness of the UV light reflecting layer 8 of MgO was 1.5 $\mu$m. The front plate 1 was subsequently used for assembling a plasma picture screen which showed an enhanced luminance.

Embodiment 2

100 ml of a 10% colloidal suspension of $SiO_2$ particles with a particle diameter of 200 nm were mixed with 10 ml of a 10% pigment dispersing agent solution and 20 ml of a 10% associative thickener solution. The entire mixture was thoroughly mixed. A layer of $SiO_2$ particles was provided as a UV light reflecting layer 8 on the protective layer 5 of a front plate 1 by means of spin coating, which front plate comprises a glass plate 3, a dielectric layer 4, a protective layer 5, and two discharge electrodes 6, 7. The dielectric layer 4 comprised glass containing PbO, the protective layer 5 comprised MgO, and the two discharge electrodes 6, 7 were made of ITO. The entire front plate 1 was dried and given an aftertreatment at 450° C. for two hours. The layer thickness of the UV light reflecting layer 8 of $SiO_2$ was 0.5 $\mu$m. The front plate 1 was subsequently used for assembling a plasma picture screen which showed an enhanced luminance.

Embodiment 3

10 g aluminum isopropylate were added to 150 ml $H_2O$ which had previously been heated to 70° C. The mixture was heated for 2 h in a reflow process and subsequently mixed with 0.5 ml glacial acetic acid. The entire mixture was then heated once more for 10 hours in a reflow process. A suspension was obtained which contained $Al_2O_3$ particles with an average particle diameter of 300 nm. After the addition of 10 ml of a 10% associative thickener solution, the resulting suspension was thoroughly mixed. A layer of $Al_2O_3$ particles was provided as a UV light reflecting layer 8 on the protective layer 5 of a front plate 1 by means of spin coating, which front plate comprises a glass plate 3, a dielectric layer 4 of glass containing PbO, a protective layer 5 of MgO, and two discharge electrodes 6, 7 made of ITO. The entire front plate 1 was dried and given an aftertreatmnent at 450° C. for two hours. The layer thickness of the UV light reflecting layer 8 of $Al_2O_3$ was 0.8 $\mu$m. The front plate 1 was subsequently used for assembling a plasma picture screen which showed an enhanced luminance.

Embodiment 4

A solution of 4 g $Mg(NO_3)_2 \cdot H_2O$ and 1.2 g $NH_4F$ in 100 ml $H_2O$ was set for a pH value of 7.5 through the addition of 2M soda lye. The pH value was raised to 11.0 through the introduction of $NH_3$ during a period of 4 h. $MgF_2$ particles with a particle diameter of on average 400 nm were formed thereby. The resulting suspension was mixed with 10 ml of a 10% pigment dispersing agent solution and 10 nm of a 10% associative thickener solution. A layer of $MgF_2$ particles was provided as a UV light reflecting layer 8 on the protective layer 5 of a front plate 1 by means of spin coating, which front plate comprises a glass plate 3, a dielectric layer 4, a protective layer 5, and two discharge electrodes 6, 7. The dielectric layer 4 comprised glass containing PbO, the protective layer 5 comprised MgO, and the two discharge electrodes 6, 7 were made of ITO. The entire front plate 1 was dried and given an aftertreatment at 450° C. for two hours. The layer thickness of the UV light reflecting layer 8 of $MgF_2$ was 1.0 $\mu$m. The front plate 1 was subsequently used for assembling a plasma picture screen which showed an enhanced luminance.

Embodiment 5

The pH value of a solution of 2.0 g $Ca(NO_3)_2 \cdot 4H_2)$ in 50 ml $H_2O$ was set for 7.5 through the addition of 2M soda lye. This solution was slowly dripped into a solution of 1.7 g sodium metaphosphate (Graham's salt) in 50 ml $H_2O$. A suspension in which calcium phosphate particles with a particle diameter from 270 nm to 290 nm were present was obtained after one hour of stirring. The suspension was mixed with 10 ml of a 10% pigment dispersing agent solution under stirring. A layer of $Ca_3(PO_4)_2$ particles was provided on the protective layer 5 of a front plate 1 as a UV light reflecting layer 8 by means of spin coating, which front plate comprises a glass plate 3, a dielectric layer 4, a protective layer 5, and two discharge electrodes 6, 7. The dielectric layer 4 comprised glass containing PbO, the protective layer 5 comprised MgO, and the two discharge electrodes 6, 7 were made of ITO. The entire front plate 1 was dried and given an aftertreatment at 450° C. for two hours. The layer thickness of the UV light reflecting layer 8 of $Ca_3(PO_4)_2$ was 0.7 $\mu$m. The front plate 1 was subsequently used for assembling a plasma picture screen which showed an enhanced luminance.

Embodiment 6

150 g $Al_2O_3$ prepared by flame pyrolysis and having a particle diameter of up to 200 nm was slowly stirred into a 0.005 molar solution of ammonium acetate in 500 ml distilled water with a stirrer. The suspension resulting from the above was treated for 15 minutes in an ultrasonic sonotrode. The suspension was mixed with 25.0 ml of a 4.7% solution of polyvinyl alcohol in water under stirring. The suspension was subsequently purified by filtration.

A layer of $Al_2O_3$ particles was provided as a UV light reflecting layer 8 on the protective layer 5 of a front plate 1 by means of spin coating, which front plate comprises a glass plate 3, a dielectric layer 4, a protective layer 5, and two discharge electrodes 6, 7. The dielectric layer 4 comprised PbO, the protective layer 5 comprised MgO, and the two discharge electrodes 6, 7 were made of ITO. The front plate 1 was first dried and then subjected to a thermal aftertreatment at 450° C. for two hours. The layer thickness of the UV reflecting layer 8 of $Al_2O_3$ was 2.0 $\mu$m. The front plate 1 was subsequently used for assembling a plasma picture screen which showed an enhanced luminance.

Embodiment 7

A solution of 21.4 mg ammonium chloride p.a. in 400 g distilled water was stirred at room temperature with a stirrer and slowly mixed with 200 g pyrogenic silicic acid with a particle diameter of between 10 and 110 nm. After this addition had been completed, the resulting suspension was placed in an ultrasonic bath for 60 minutes, during which the suspension was continuously stirred. Under stirring, the suspension was mixed with 5.0 ml of a 1% aqueous polymer solution of an associative thickener which bad been set for a pH value of 9.5 by means of ammonia gas. The suspension thus obtained was subsequently purified by filtration.

A layer of $SiO_2$ particles was provided as a UV light reflecting layer 8 on the protective layer 5 of a front plate 1 by means of spin coating, which front plate comprises a glass plate 3, a dielectric layer 4, a protective layer 5, and two discharge electrodes 6, 7. The dielectric layer 4 comprised glass containing PbO, the protective layer 5 comprised MgO, and the two discharge electrodes 6, 7 were made of ITO. The front plate 1 was first dried and subsequently subjected to a thermal aftertreatment at 450° C. for two hours. The layer thickness of the UV reflecting layer 8 of $SiO_2$ was 3.0 $\mu$m. The front plate 1 was subsequently used for assembling a plasma picture screen which showed an enhanced luminance.

Furthermore, a cleaned quartz plate was coated with the suspension in a spin coating process. After drying in a drying cabinet and an aftertreatment of the coated quartz plate at 450° C. in air, a transparent $SiO_2$ layer with a layer thickness of 3.0 $\mu$m was obtained. The reflection of this $SiO_2$ layer as a function of the wavelength over a range from 100 nm to 600 nm is plotted in FIG. 2.

Embodiment 8

A 0.003 molar solution of 250 g analytical grade (p.a.) armonium fluoride in distilled water was stirred at room temperature with a stirrer and slowly mixed with 100 g amorphous $SiO_2$ with a particle diameter of 20 nm. After this addition had been completed, the resulting suspension was treated with an ultraturrax stirring rod for 10 minutes. While stirring, the suspension was mixed with 50 ml of a 10% aqueous suspension of a fully dispersed, pyrogenic silicic acid with a particle size between 10 and 20 nm. An aqueous solution of 33 g polyacryl amide was also added to the suspension under stirring. The resulting suspension was then cleaned by filtration.

A layer of $SiO_2$ particles was provided as an UV light reflecting layer 8 on the protective layer 5 of a front plate 1 by means of spin coating, which front plate comprises a glass plate 3, a dielectric layer 4, a protective layer 5, and two discharge electrodes 6, 7. The dielectric layer 4 comprised glass containing PbO, the protective layer 5 comprised MgO, and the two discharge electrodes 6, 7 were made of ITO. The front plate 1 was first dried and then subjected to a thermal aftertreatment at 490° C. for 2 h. The layer thickness, of the UV reflecting layer 8 of $SiO_2$ was 2.5 $\mu$m. The front plate 1 was subsequently used for assembling a plasma picture screen which showed an enhanced luminance.

What is claimed is:

1. A plasma picture screen, comprising:

a front plate;

a back plate;

a plurality of gab-filled plasma cells arranged between the front and back plates and separated by partitioning walls; and a plurality of electrodes on the front plate and the back plate for generating corona discharges, wherein the front plate includes a glass plate on which a dielectric layer, a protective layer and a UV light reflecting layer are provided, the protective layer is between the dielectric layer and the UV light reflecting layer, wherein the UV light reflective layer covers only a portion of the protective layer.

2. A plasma picture screen as claimed in claim 1, wherein the UV light reflecting layer includes oxides of the composition $M_2O$, such as $Li_2O$, or oxides of the composition MO, with M chosen from the group Mg, Ca, Sr, and Pa, or oxides of the composition $M_2O_3$, with M chosen from the group B, Al, Sc, Y, and La, or oxides of the composition $MO_2$, with M chosen from the group Si, Ge, Sn, Ti, Zr, and Hf, or oxides of the composition $M'M''_2O_4$, with M' chosen from the group Mg, Ca, Sr, and Pa, and M" chosen from the group Al, Sc, Y, and La, or fluorides of the composition MF, with M chosen from the group Li, Ka, K, Rb, Cs, and Ag, or fluorides of the composition $MF_2$, with M chosen from the group Mg, Ca, Sr, Ba, Sn, Cu, Zn, and Pb, or fluorides of the composition $MF_3$, with M chosen from the group La, Pr, Sm, Eu, Gd, Yb, and Lu, or fluorides of the composition $M'M''F_3$, with M' chosen from the group Li, Na, K, Rb, and Cs, and M" chosen from the group Mg, Ca, Sr, and Ba, or phosphates of the composition $M_3PO_4$, with M chosen from the group Li, Na, K, Rb, and CB, or phosphates of the composition $M_3(PO_4)_2$, with M chosen from the group Mg, Ca, Sr, and Ba, or phosphates of the composition $MPO_4$, with M chosen from the group Al, Sc, Y, La, Pr, Sm, Eu, Gd, Yb, and Lu, or phosphates of the composition $M_3(PO_4)_4$, with M chosen from the group Ti, Zr, and Hf, or metaphosphates with a chain length n of between 3 and 9 and the composition $(M_xPO_3)_n$, with x=1 if M is chosen from the group Li, Na, K, Rb, and Cs, x=½ if M is chosen from the group Mg, Ca, Sr, Ba, Sn, Cu, Zn, and Pb, x=⅓ if M is chosen from the group Al, Sc, Y, La, Pr, Sm, Eu, Gd, Yb, and Lu, and x=¼ if M is chosen from the group Ti, Hf, and Zr, or polyphosphates with a chain length n between $10^1$ and $10^6$ and the composition $(M_xPO_3)_n$, with x=1 if M is chosen from the group Li, Na, K, Rb, and Cs, x=½ if M is chosen from the group Mg, Ca, Sr, Ba, Sn, Cu, Zn, and Pb, x=⅓ if M is chosen from the group Al, Sc, Y, La, Pr, Sm, Eu, Gd, Yb, and Lu, and x=¼ if M is chosen from the group Ti, Hf, and Zr, or primary phosphates of the composition $MH_2PO_4$, with M chosen from the group Li, Na, K, Rb, and Cs, or $NH_4H_2PO_4$, or diamond.

3. A plasma picture screen as claimed in claim 1, wherein the UV light reflecting layer includes particles with a particle diameter of between 200 nm and 500 nm.

4. A plasma picture screen as claimed in claim 3, wherein the UV light reflecting layer has a thickness of 0.5 $\mu$m to 5 $\mu$m.

5. A plasma picture screen as claimed in claim 1, wherein the UV light reflecting layer comprises agglomerates of particles having particle diameters of between 10 nm and 200 nm.

6. A plasma picture screen as claimed in claim 5, wherein the UV light reflecting layer has a thickness of 0.2 $\mu$m to 10 $\mu$m.

* * * * *